US006220465B1

(12) United States Patent
Jones

(10) Patent No.: US 6,220,465 B1
(45) Date of Patent: Apr. 24, 2001

(54) FREEZER ORGANIZER SYSTEM

(76) Inventor: Herman Jones, 536 Poplar St., Kingston, NC (US) 28504

( * ) Notice: Subject to any disclaimer, the term of this patent is extended or adjusted under 35 U.S.C. 154(b) by 0 days.

(21) Appl. No.: 09/467,974

(22) Filed: Dec. 21, 1999

(51) Int. Cl.[7] ..... A47B 47/00
(52) U.S. Cl. ..... 211/194
(58) Field of Search ..... 312/111, 107, 312/108, 327, 328, 138.1; 211/189, 74, 194

(56) References Cited

U.S. PATENT DOCUMENTS

| | | | | |
|---|---|---|---|---|
| 194,890 | * | 9/1877 | Camp | 312/111 |
| 3,552,817 | * | 1/1971 | Marcolongo | 312/107 |
| 3,757,958 | | 9/1973 | Kirkemo . | |
| 3,998,170 | | 12/1976 | Gordon . | |
| 4,055,373 | * | 10/1977 | Andresen et al. | 312/108 |
| 4,138,175 | | 2/1979 | Tattershall . | |
| 4,174,486 | | 11/1979 | Winkler . | |
| 4,460,096 | | 7/1984 | Ricci . | |
| 4,840,279 | | 6/1989 | Cobb et al. . | |
| 5,148,928 | | 9/1992 | Arnold . | |
| 5,221,013 | | 6/1993 | Santucci . | |
| 5,228,764 | | 7/1993 | Bird et al. . | |
| 5,342,122 | * | 8/1994 | Gordon | 312/111 |
| 5,362,145 | | 11/1994 | Cherry et al. . | |
| 5,584,405 | | 12/1996 | Tunzi . | |
| 5,788,094 | | 8/1998 | Kim et al. . | |

* cited by examiner

*Primary Examiner*—Alvin Chu-Shue
*Assistant Examiner*—Sarah Purol
(74) *Attorney, Agent, or Firm*—McCullough & Associates, Ltd.

(57) ABSTRACT

The present invention would be fabricated from a plurality of rectangular boxes having several external slots along their outer surface. The rectangular boxes would be placed against one another, and would have a plurality of female tracks running lengthwise along each outer surface. Female tracks from adjoining boxes would join up, allowing a male track to be inserted through both female tracks, locking them in place. The present invention would include a center-mounted rectangular box which would include a hinged door. Additional rectangular boxes could be made available for use if desired, depending on the size of a particular freezer unit. The present invention would be sold as a kit, and would come in configurations to fit top mounted, side mounted, and full freezers.

1 Claim, 3 Drawing Sheets

FREEZER ORGANIZER SYSTEM

I BACKGROUND OF THE INVENTION

The present invention concerns that of a new and improved organizer for a freezer.

II. DESCRIPTION OF THE PRIOR ART

U.S. Pat. No. 5,788,094, issued to Kim et al., discloses a shelf construction in a refrigerator which includes a pair of guide rails provided on opposite sidewalls of a refrigerator compartment.

U.S. Pat. No. 5,584,405, issued to Tunzi, discloses an adjustable shelf for a refrigerator compartment which has two parts, a platform and a support member and provides adjustment of both the length and the height of the shelf.

U.S. Pat. No. 5,362,145, issued to Bird et al., discloses a molded refrigerator shelf useful for containment of spills on the shelf.

U.S. Pat. No. 5,228,764, issued to Cherry et al., discloses a household refrigerator shelf assembly which includes a unitary support structure having a rear and spaced apart side wall with a horizontally-oriented channel extending around the periphery of the structure.

U.S. Pat. No. 5,221,013, issued to Santucci, discloses an add-on shelf for athletic or school lockers having hinged first and second planar shelf members.

U.S. Pat. No. 5,148,928, issued to Arnold, discloses a shelf system having a wire shelf and end brackets.

U.S. Pat. No. 4,840,279, issued to Cobb et al., discloses a storage rack comprising a pair of brackets, each of which preferably and advantageously is of a two piece construction so that they can be easily packaged for storage and shipping.

U.S. Pat. No. 4,460,096, issued to Ricci, discloses a variable shelf organizer adapted to be assembled to provide shelf organizers of various sizes.

U.S. Pat. No. 4,174,486, issued to Winkler, discloses an adjustable shelving system comprising two or more upright standards each having a forwardly projecting shelf support member pivotly depending therefrom which is infinitely vertically adjustable.

U.S. Pat. No. 4,138,175, issued to Tattershall, discloses a space saving and organizing means particularly designed and constructed for use with refrigeration, freezers, freezer compartments and the like.

U.S. Pat. No. 3,998,170, issued to Gordon, discloses an adjustable wire shelf for frozen foods and the like.

U.S. Pat. No. 3,757,958, issued to Kirkemo, discloses a device described for preventing food and other items stored on the shelves of refrigerators and the like from slipping from the shelves after the refrigerator or other storage device has been subject to jostling and the door thereof is subsequently opened.

III. SUMMARY OF THE INVENTION

The present invention would be fabricated from a plurality of rectangular boxes having several external slots along their outer surface. The rectangular boxes would be placed against one another, and would have a plurality of female tracks running lengthwise along each outer surface. Female tracks from adjoining boxes would join up, allowing a male track to be inserted through both female tracks, locking them in place. The present invention would include a center-mounted rectangular box which would include a hinged door. Additional rectangular boxes could be made available for use if desired, depending on the size of that particular freezer unit. The present invention would be sold as a kit, and would come in configurations to fit top-mounted, side-mounted, and full freezers.

It is therefore an object of the present invention to provide a new and improved freezer organizer.

It is another object of the present invention to provide a new and improved freezer organizer that will provide better organization for freezer contents.

It is yet another object of the present invention to provide a new and improved freezer organizer that is easy and inexpensive to manufacture.

It is still another object of the present invention to provide a new and improved freezer organizer that will save time and effort.

It is still another object of the present invention to provide a new and improved freezer organizer that will provide ease of use.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
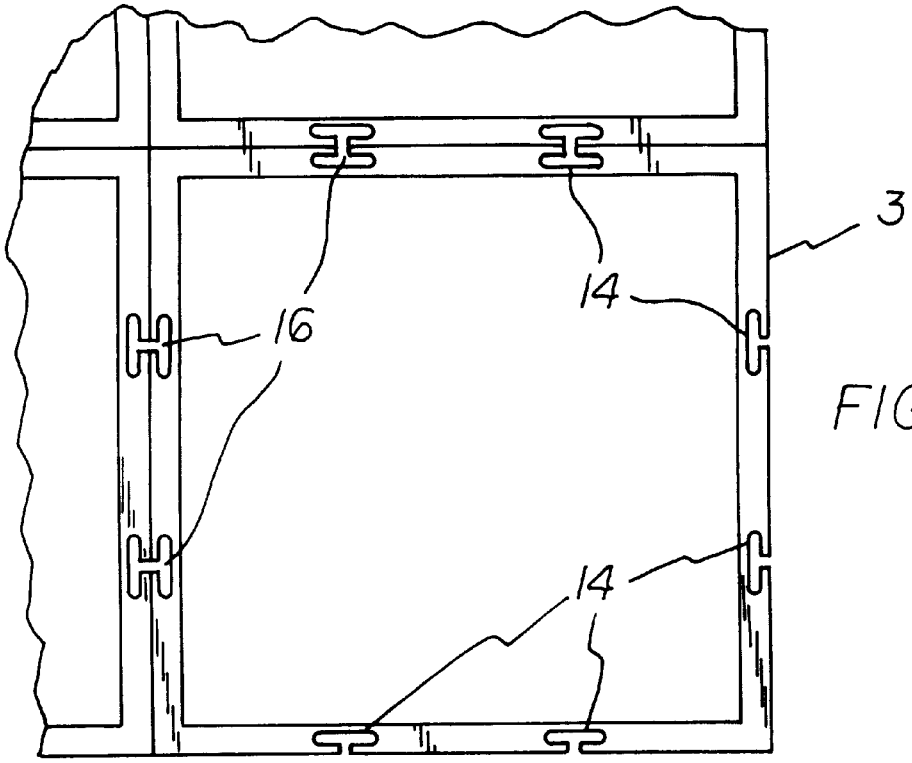
FIG. 1 shows a front view of a single rectangular box of the present invention.

FIG. 1 shows a front view of a single unit 3 of the present invention. Each unit 3 is in the shape of a rectangular box, with four side walls of equal dimensions. Each side wall would be in the shape of a rectangle. Each unit 3 would also have a square back face, but would not have a front face, which would be open to a user.

Each side wall of a unit 3 of the present invention would have an inner surface and an outer surface. The outer surface of each side wall of each unit 3 of the present invention would include a pair of female partition tracks 14. Each outer surface of each unit 3 would have the pair of female partition tracks 14 in the same location to allow female partition tracks 14 from an adjacent unit 3 to properly match up with each other.

Each female partition track 14 would be shaped as an inverted "T" and would comprise a running cutout track along an outer surface of a unit 3. The base of the "T"-shaped track would be placed against the outer surface of a particular unit 3, with the upper branch of the "T" extending along the same plane as the side wall to which the female partition track 14 would be attached. Each female partition track 14 would not necessarily extend the entire length from the front face to the back face, but would travel back several inches to ensure that adjoining unit 3's could be effectively attached to one another.

Figure 2:
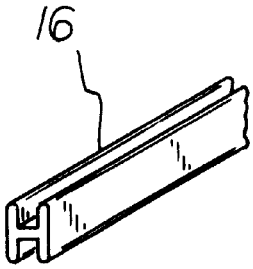
FIG. 2 shows an isometric view of a male connection track.

FIG. 2 shows an isometric view of a male connection track 16. Male connection 16 is designed to be inserted into two adjoining two female partition track 14's which have been pushed together. The two adjoining female partition tracks 14 would be located on adjacent unit 3's, with male connection track 16 serving to hold the adjacent female partition track 14's together.

Figure 3:
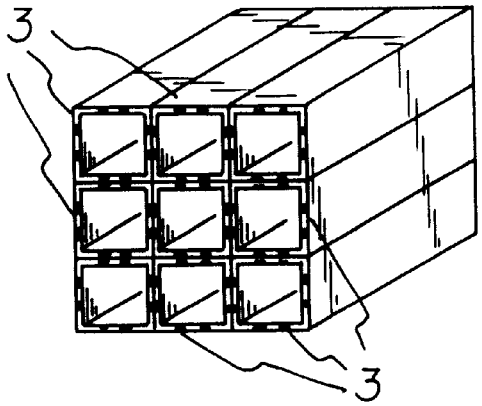
FIG. 3 shows a plurality of rectangular boxes of the present invention removably attached to one another.

FIG. 3 shows a plurality of unit 3's removably attached to one another before placement into a partition frame 4 located in a freezer unit 6 of a standard refrigerator/freezer unit. Designed as a 3×3 unit in the drawings to illustrate the invention, the dimensions of the plurality of unit 3's attached to one another can vary significantly, depending on a particular freezer unit 6.

Figure 4:
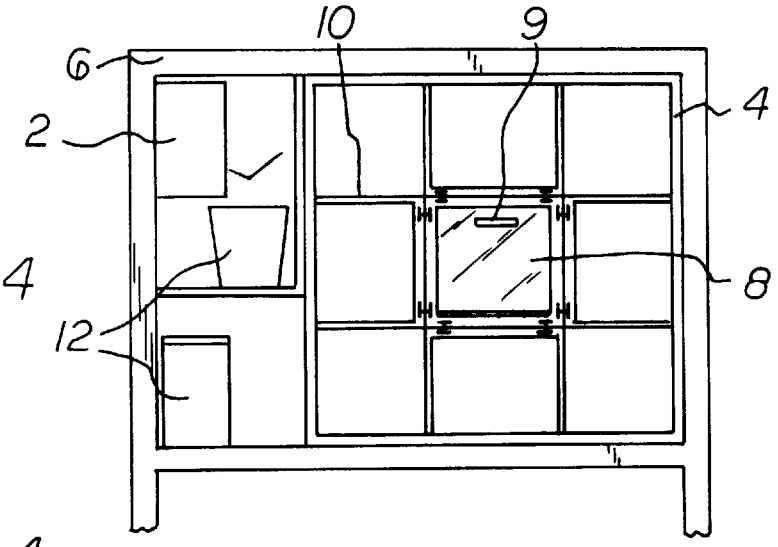
FIG. 4 shows a front view of the present invention as it would appear in a freezer unit.

FIG. 4 shows a front view of the present invention as it would appear in a freezer unit 6. Freezer unit 6 would include a standard ice-maker 2 and corresponding ice trays 12 in a portion not occupied by the plurality of unit 3's. One or more of the unit 3's would have a front-mounted hinged door 8 which would include a handle 9. Each hinged door 8 would open downward.

Figure 5:
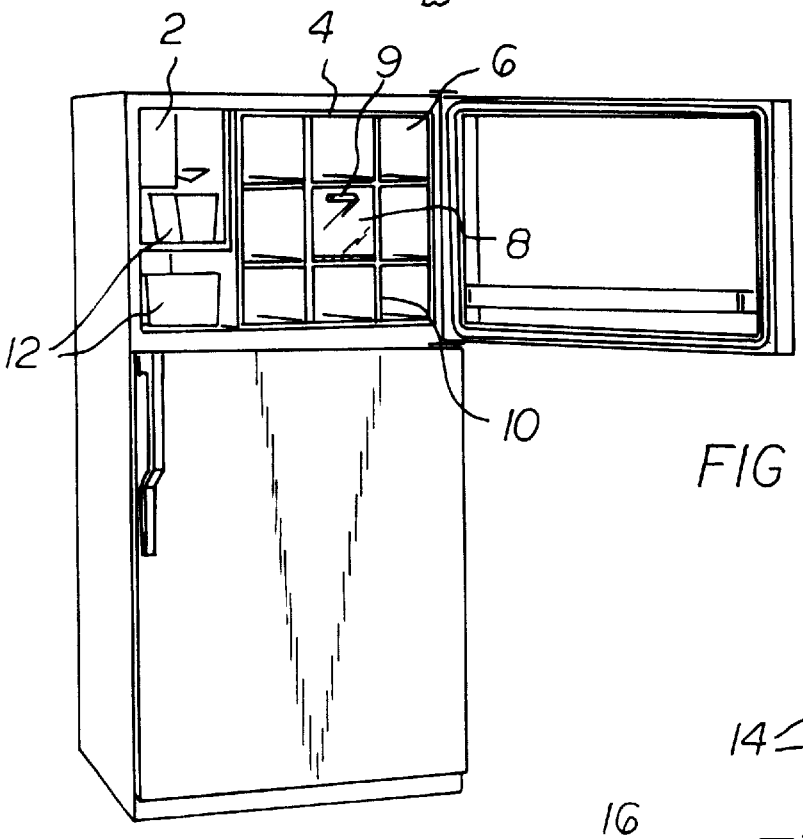
FIG. 5 shows an isometric view of the present invention as it would appear in a freezer unit.

FIG. 5 shows an isometric view of the present invention as it would appear in a freezer unit 6 of a typical refrigerator/freezer combination.

Figure 6:
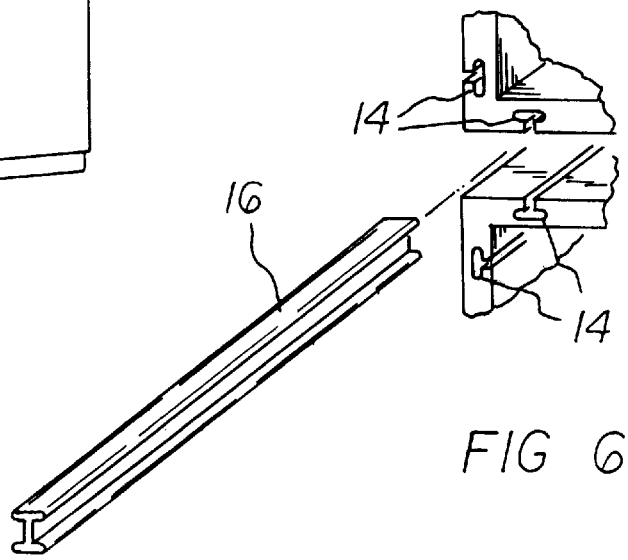
FIG. 6 shows an isometric view of two adjoining rectangular boxes.

FIG. 6 shows an isometric view of two adjoining unit 3's, along with their adjoining female partition track 14's and the male connection track 16 used to connect the two adjoining female partition track 14's.

Figure 7:
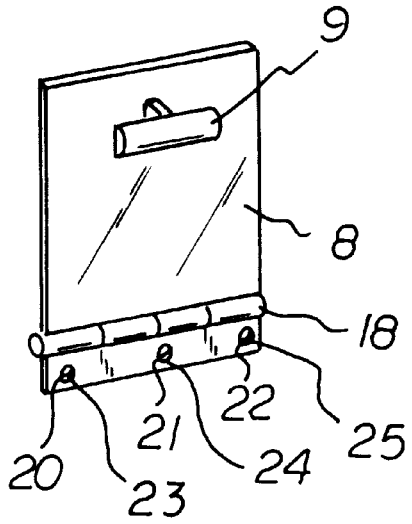
FIG. 7 shows an isometric closeup view of the hinged door of the present invention.

FIG. 7 shows an isometric closeup view of the hinged door 8, which includes a front mounted handle 9. Hinged door 8 is attached to a unit 3 by piano-type hinge 18, which is attached by inserting attachment screws 23, 24, and 25 through holes 20, 21, and 22. Piano-type hinge 18 is attached to hinged door 8 along the bottom edge of a particular unit 3.

Figure 8:
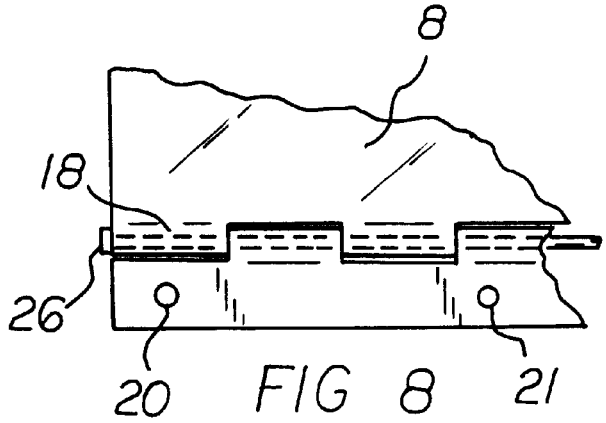
FIG. 8 shows a face view of the bottom edge of a hinged door with the piano-type hinge attached.

FIG. 8 shows a face view of the bottom edge of a hinged door 8 with piano-type hinge 18 attached. Hinge pin 26 is inserted alternatively through portions of hinged door 8 and piano-type hinge 18 in order to pivotly attach piano-type hinge 18 to hinged door 8.

Figure 9:
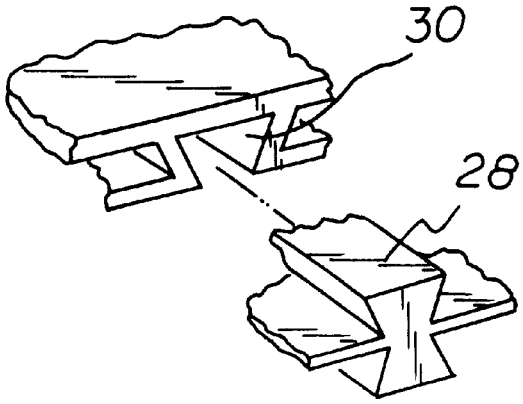
FIG. 9 shows an optional male connection track and optional female connection track, which can be used in place of said male connection track and said female partition track respectively.

FIG. 9 shows optional male connection track 28 and optional female connection track 30, which are alternative shapes for male connection track 16 and female partition track 14, respectively. The extension for optional male connection track 28 is in the shape of a dove tail, while the indentation or optional female connection track 30 has a shape of a mortise.

What I claim as my invention is:

1. A freezer organizer, said freezer organizer comprising:

a. a plurality of rectangular boxes, each of said rectangular boxes including four side walls, each of said four side walls designed in the shape of a rectangle, said four sidewalls comprising a top side wall, a bottom side wall, a left side wall, and a right side wall, each of said side walls having an inner surface and an outer surface, each of said rectangular box also including a rear surface, and each of said rectangular boxes also including an open front face, each of said side walls including a pair of female partition tracks attached to the outer surface of each of said side walls, each of said female partition tracks running from front to back, each of said female partition tracks being shaped in the shape of an inverted "T," wherein each outer surface of each side wall of each rectangular box would include said pair of female partition tracks in the same location to allow a first specific female partition track from a first specific rectangular box to be immediately adjacent to a second specific female partition track from a second specific rectangular box when the first specific rectangular box is placed immediately adjacent to the second specific rectangular box, b. a male connection track, said male connection track designed to be inserted into two adjacent female partition tracks located on two adjacent rectangular boxes, said male connection tracks serving as a connecting device for said two adjacent rectangular boxes, c. at least one hinged door, said hinged door attached to an open front face of a rectangular box, said hinged door including a handle, said hinged door opening in a downwardly manner, d. a frame, said frame being placed in a freezer compartment in a standard freezer or a standard refrigerator/freezer unit, and e. wherein said plurality of rectangular boxes are placed on top of one another in a square like grid, said plurality of rectangular boxes being placed within said frame, wherein said male connection tracks are used to connect two adjacent female partition tracks.

* * * * *

UNITED STATES PATENT AND TRADEMARK OFFICE

CERTIFICATE OF CORRECTION

PATENT NO. : 6,220,465 B1
DATED : April 24, 2001
INVENTOR(S) : Herman Jones

It is certified that error appears in the above-identified patent and that said Letters Patent is hereby corrected as shown below:

Title page,
In inventor Herman Jones' address, delete "Kingston" and insert -- Kinston --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*